US010173436B2

(12) United States Patent
Yoshida et al.

(10) Patent No.: US 10,173,436 B2
(45) Date of Patent: Jan. 8, 2019

(54) LIQUID CIRCULATION DEVICE AND LIQUID DISCHARGE APPARATUS

(71) Applicants: Satoru Yoshida, Ibaraki (JP); Yuta Moriwaki, Kanagawa (JP); Tomomi Katoh, Kanagawa (JP)

(72) Inventors: Satoru Yoshida, Ibaraki (JP); Yuta Moriwaki, Kanagawa (JP); Tomomi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/817,342

(22) Filed: Nov. 20, 2017

(65) Prior Publication Data

US 2018/0147854 A1 May 31, 2018

(30) Foreign Application Priority Data

Nov. 30, 2016 (JP) ..... 2016-231934
Aug. 28, 2017 (JP) ..... 2017-163166

(51) Int. Cl.

| | |
|---|---|
| ***B41J 2/175*** | (2006.01) |
| ***B41J 2/18*** | (2006.01) |
| ***B41J 2/19*** | (2006.01) |
| ***B41J 2/14*** | (2006.01) |

(52) U.S. Cl.

CPC ..... *B41J 2/18* (2013.01); *B41J 2/14274* (2013.01); *B41J 2/17596* (2013.01); *B41J 2/19* (2013.01); *B41J 2202/12* (2013.01)

(58) Field of Classification Search

CPC ..... B41J 2/14274; B41J 2/17509; B41J 2/17596; B41J 2/18; B41J 2/19; B41J 2202/12

See application file for complete search history.

(56) References Cited

U.S. PATENT DOCUMENTS

| | | | | |
|---|---|---|---|---|
| 7,472,987 | B2 * | 1/2009 | Uchida | B41J 2/175 347/85 |
| 8,100,500 | B2 * | 1/2012 | Bansyo | B41J 2/16532 347/19 |
| 8,556,395 | B2 * | 10/2013 | Hiratsuka | B41J 2/16526 347/85 |
| 9,616,673 | B2 * | 4/2017 | Domae | B41J 2/18 |
| 2013/0235131 | A1 | 9/2013 | Watanabe et al. | |

FOREIGN PATENT DOCUMENTS

| | | |
|---|---|---|
| JP | 2011-079169 | 4/2011 |
| JP | 2013-216077 | 10/2013 |

* cited by examiner

*Primary Examiner* — Anh T. N. Vo
(74) *Attorney, Agent, or Firm* — Oblon, McClelland, Maier & Neustadt, L.L.P.

(57) ABSTRACT

There is provided a liquid circulation apparatus for circulating liquid through a plurality of discharge heads that includes discharge nozzles. The liquid circulation apparatus includes a liquid circulating channel to circulate the liquid via the plurality of discharge heads, a first manifold connected to each supply port of the plurality of discharge heads, a second manifold connected to each discharge port of the plurality of discharge heads, a discharging channel to discharge the liquid in the second manifold, and a bubble-discharging channel separate from the discharging channel, to discharge bubbles in the second manifold.

14 Claims, 9 Drawing Sheets

LIQUID CIRCULATION DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2016-231934, filed on Nov. 30, 2016 in the Japan Patent Office and Japanese Patent Application No. 2017-163166, filed on Aug. 28, 2017 in the Japan Patent Office, the entire disclosures of which are hereby incorporated by reference herein.

BACKGROUND

Technical Field

Aspects of the present disclosure relate to a liquid circulation device and a liquid discharge apparatus.

Related Art

In a liquid discharge apparatus that uses a liquid discharge head, bubbles entering the liquid discharge head can cause discharge failure. Thus, a flow-through-type or circulation-type liquid discharge head is used to circulate liquid to de-gas the liquid, that is, to remove any gas from the liquid.

A liquid circulation system is known that includes a liquid supply manifold, a liquid collecting manifold, a first bypass channel, a liquid circulation means, and a second bypass channel. The liquid supply manifold is connected to a supply side of a plurality of circulation type heads. The liquid collecting manifold is connected to a discharge side of the plurality of circulation type heads. The first bypass channel connects the liquid supply manifold and the liquid collecting manifold. The liquid circulation means circulates the liquid. The second bypass channel connects the liquid supply manifold and the liquid collecting manifold.

SUMMARY

In an aspect of this disclosure, there is provided a novel liquid circulation apparatus for circulating liquid through a plurality of discharge heads, each of the plurality of discharge heads including a supply port, a discharge port, and discharge nozzles. The liquid circulation apparatus includes a liquid circulating channel to circulate the liquid via the plurality of discharge heads, a first manifold connected to each supply port of the plurality of discharge heads, a second manifold connected to each discharge port of the plurality of discharge heads, a discharging channel to discharge the liquid in the second manifold, and a bubble-discharging channel separate from the discharging channel to discharge bubbles in the second manifold.

In another aspect of this disclosure, there is provided a liquid circulation apparatus for circulating liquid through a plurality of discharge heads, each of the plurality of discharge heads including a supply port, a discharge port, and discharge nozzles. The liquid circulation apparatus includes a liquid circulating channel to circulate the liquid via the plurality of discharge heads, a first manifold connected to the supply port of each of the plurality of discharge heads, a second manifold connected to the discharge port of each of the plurality of discharge heads, a first bubble-discharging channel to discharge bubbles from the first manifold to the second manifold, and a second bubble-discharging channel to discharge bubbles in the second manifold outside the second manifold. The first bubble-discharging channel and the second bubble-discharging channel are different from the liquid circulating channel.

In still another aspect of this disclosure, a liquid discharge apparatus includes the plurality of discharge heads, and the liquid circulation apparatus described above to circulate liquid in the plurality of discharge heads.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
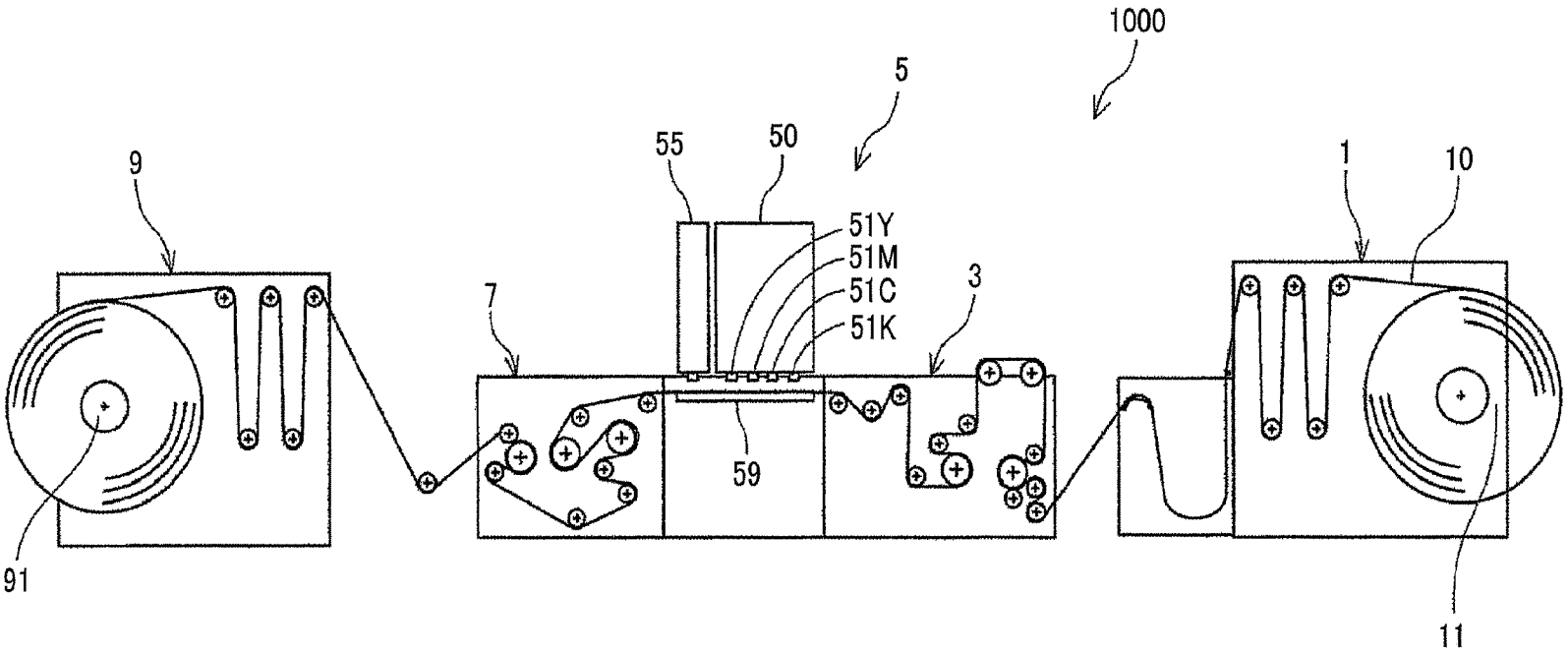
FIG. 1 is a schematic cross sectional view of a liquid discharge apparatus according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a", "an", and "the" are intended to include the plural forms as well, unless the context clearly indicates otherwise.

Referring now to the drawings, wherein like reference numerals designate identical or corresponding parts throughout the several views, embodiments of the present disclosure are described below.

A liquid discharge apparatus according to a first embodiment of the present disclosure is described in detail below with reference to FIGS. 1 and 2.

FIG. 1 is a schematic front view of the liquid discharge apparatus 1000. FIG. 2 is a plan view of a head unit of the liquid discharge apparatus 1000 of FIG. 1.

The liquid discharge apparatus 1000 according to the present embodiment includes a feeder 1 to feed a medium 10, a guide conveyor 3 to guide and convey the medium 10, fed from the feeder 1, to a printing unit 5, the printing unit 5 to discharge liquid onto the medium to form an image on the medium 10, a drier unit 7 to dry the medium 10, and an ejector 9 to eject the medium 10.

The medium 10 is fed from a roller 11 of the feeder 1, guided and conveyed with rollers of the feeder 1, the guide conveyor 3, the drier unit 7, and the ejector 9, and wound around a take-up roller 91 of the ejector 9.

In the printing unit 5, the medium 10 is conveyed opposite a first head unit 50 and a second head unit 55 on a conveyance guide 59. The first head unit 50 discharges liquid to form an image on the medium 10. Post-treatment is performed on the medium 10 with treatment liquid discharged from the second head unit 55.

Here, the first head unit 50 includes, for example, four-color full-line head arrays 51K, 51C, 51M, and 51Y (hereinafter, collectively referred to as "head arrays 51" unless colors are distinguished) from an upstream side in a feed direction of the medium 10 (hereinafter, "medium feed direction") indicated by arrow MFD in FIG. 1.

The head arrays 51K, 51C, 51M, and 51Y are liquid dischargers to discharge liquid of black (K), cyan (C), magenta (M), and yellow (Y) onto the conveyed medium 10. Note that the number and types of color are not limited to the above-described four colors of K, C, M, and Y and may be any other suitable number and types.

Figure 2:
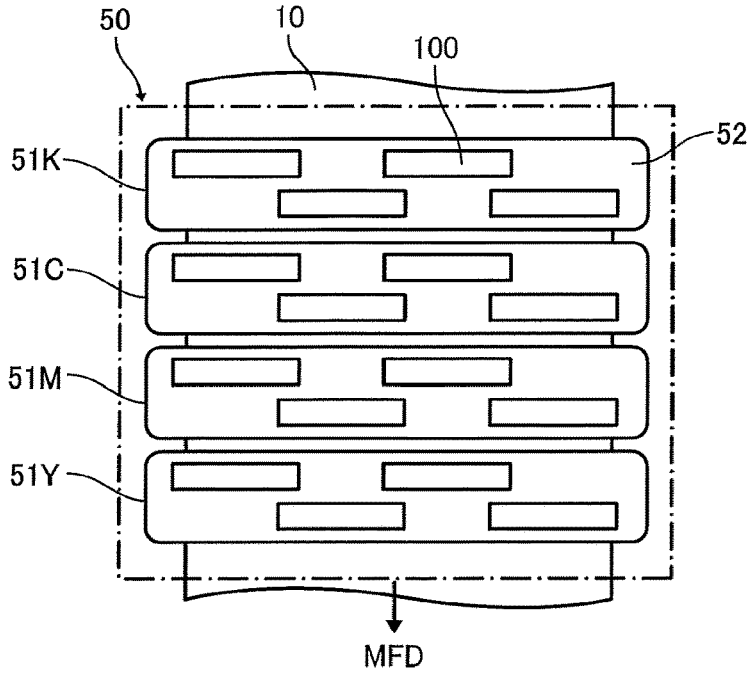
FIG. 2 is a plan view of a head unit of the liquid discharge apparatus of FIG. 1.

As illustrated in FIG. 2, in each head array 51, for example, multiple discharge heads (also referred to as simply "heads") 100 are staggered on a base 52 to form the head array 51. Note that the configuration of the head array 51 is not limited to such a configuration.

A liquid discharge head according to an embodiment of the present disclosure is described with reference to FIGS. 3 and 4.

Figure 3:
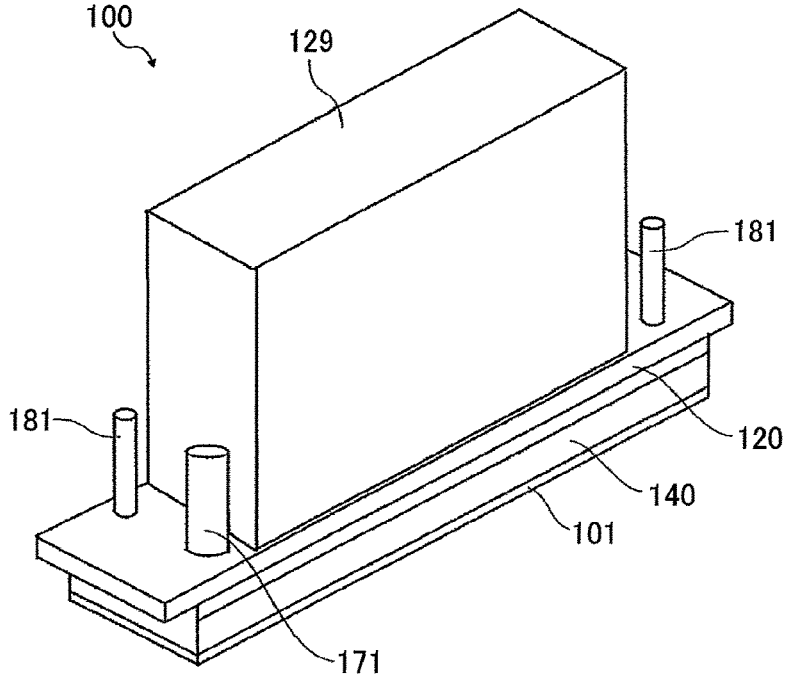
FIG. 3 is an outer perspective view of a liquid discharge head according to the embodiments.
Figure 4:
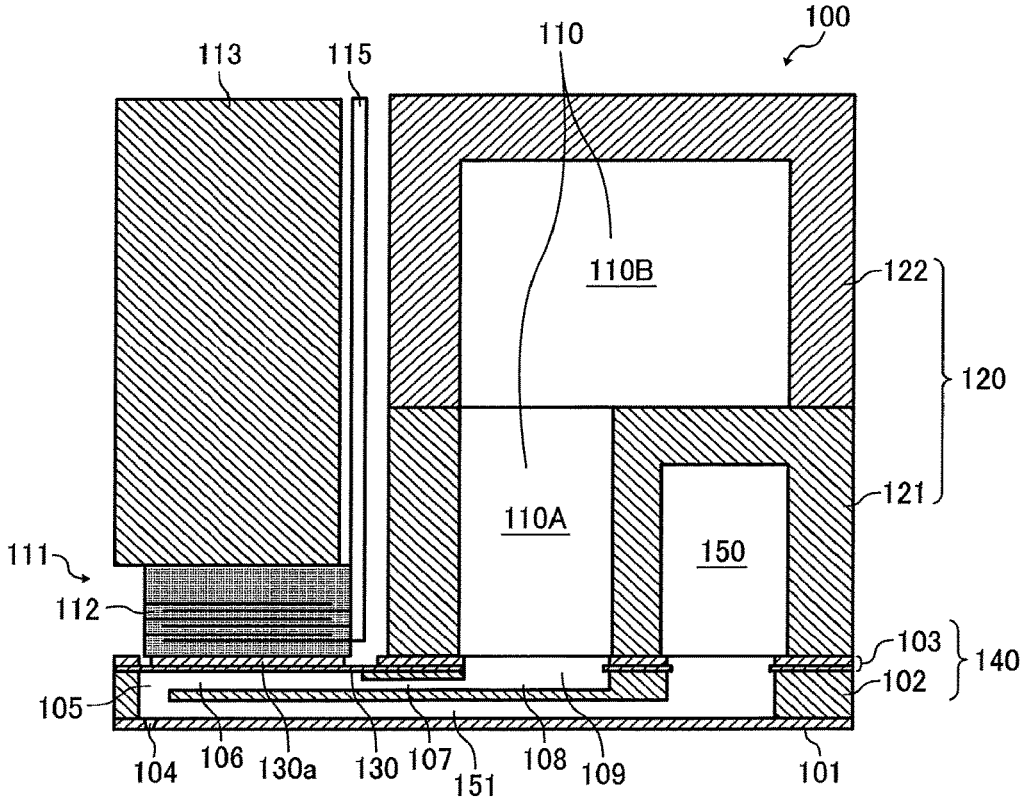
FIG. 4 is a cross-sectional view of the liquid discharge head in a direction perpendicular to a nozzle array direction in which nozzles are arrayed in a row direction (a longitudinal direction of an individual-liquid-chamber)

FIG. 3 is an outer perspective view of the head 100. FIG. 4 is a cross-sectional view of the head 100 in a direction perpendicular to a nozzle array direction in which nozzles 104 are arrayed in a row direction (a longitudinal direction of an individual-liquid-chamber 106). The head 100 includes a nozzle plate 101, a channel substrate 102, and a diaphragm member 103 as a wall member, laminated one atop another. The head 100 includes piezoelectric actuators 111 to displace a vibration portions 130 of the diaphragm member 103, a common-liquid-chamber substrate 120 also served as a frame member of the head 100, and a cover 129. The channel substrate 102 and the diaphragm member 103 constitute a channel member 140.

The nozzle plate 101 includes multiple nozzles (discharge nozzles) 104 to discharge liquid. Hereinafter, "discharge nozzles" are simply referred to as "nozzles".

The channel substrate 102 includes through-holes and grooves that form individual-liquid-chambers 106, supply-side fluid restrictors 107, and liquid introduction portions 108. The individual-liquid-chambers 106 communicate with the nozzles 104 via the nozzle communication channel 105.

The supply-side fluid restrictors 107 communicate with the individual-liquid-chambers 106. The liquid introduction portions 108 communicate with the supply-side fluid restrictors 107. The nozzle communication channel 105 communicates with each of the nozzle 104 and the individual-liquid-chamber 106. The liquid introduction portions 108 communicate with the supply-side common-liquid-chamber 110 via the opening 109 of the diaphragm member 103.

The diaphragm member 103 includes the deformable vibration portions 130 constituting walls of the individual-liquid-chambers 106 of the channel substrate 102. In the present embodiment, the diaphragm member 103 has a two-layer structure including a first layer and a second layer. The first layer forms thin portions from the channel substrate 102. The second layer forms thick portions. The first layer includes the deformable vibration portions 130 at positions corresponding to the individual-liquid-chambers 106. Note that the diaphragm member 103 is not limited to the two-layer structure and the number of layers may be any other suitable number.

On the opposite side of the individual-liquid-chamber 106 of the diaphragm member 103, there is arranged the piezoelectric actuator 111 including an electromechanical transducer element as a driver (e.g., actuator, pressure generator) to deform the vibration portion 130 of the diaphragm member 103.

The piezoelectric actuator 111 includes piezoelectric elements 112 bonded on a base 113. The piezoelectric elements 112 are groove-processed by half cut dicing so that each piezoelectric elements 112 includes a desired number of pillar-shaped piezoelectric elements 112 that are arranged in certain intervals to have a comb shape.

The piezoelectric element 112 is joined to a convex portion 130*a*, which is a thick portion having an island-like form formed on the vibration portion 130 of the diaphragm member 103. In addition, a flexible printed circuit (FPC) 115 is connected with the piezoelectric elements 112.

The common-liquid-chamber substrate 120 includes a supply-side common-liquid-chamber 110 and a drainage-side common-liquid-chamber 150. The supply-side common-liquid-chamber 110 is communicated with supply ports 171. The drainage-side common-liquid-chamber 150 is communicated with the discharge ports 181 (See FIG. 3).

Note that, in the present embodiment, the common-liquid-chamber substrate 120 includes a first common-liquid-chamber substrate 121 and a second common-liquid-chamber substrate 122. The first common-liquid-chamber substrate 121 is bonded to the diaphragm member 103 of the channel member 140. The second common-liquid-chamber substrate 122 is laminated on and bonded to the first common-liquid-chamber substrate 121.

The first common-liquid-chamber substrate 121 includes a downstream common-liquid-chamber 110A and the drainage-side common-liquid-chamber 150. The downstream common-liquid-chamber 110A is part of the supply-side common-liquid-chamber 110 communicated with the liquid introduction portion 108. The drainage-side common-liquid-chamber 150 communicates with a drainage channel 151. The second common-liquid-chamber substrate 122 includes an upstream common-liquid-chamber 110B that is a remaining portion of the supply-side common-liquid-chamber 110.

The channel substrate 102 includes the drainage channels 151 formed along a surface direction of the channel substrate 102 and communicated with the individual-liquid-chambers 106 via the nozzle communication channel 105. The drainage channels 151 communicate with the drainage-side common-liquid-chamber 150.

In the liquid discharge head 100 thus configured, for example, when a voltage lower than a reference potential (intermediate potential) is applied to the piezoelectric element 112, the piezoelectric element 112 contracts. Accordingly, the vibration portion 130 of the diaphragm member 103 is pulled to increase the volume of the individual-liquid-chamber 106, thus causing liquid to flow into the individual-liquid-chamber 106.

When the voltage applied to the piezoelectric element 112 is raised, the piezoelectric element 112 extends in a direction of lamination. Accordingly, the vibration portion 130 of the diaphragm member 103 deforms in a direction toward the nozzle 104 and the volume of the individual-liquid-chamber 106 reduces. Thus, liquid in the individual-liquid-chamber 106 is pressurized and discharged from the nozzle 104.

Liquid not discharged from the nozzles 104 passes the nozzles 104, and are drained from the drainage channels 151 to the drainage-side common-liquid-chamber 150 and supplied from the drainage-side common-liquid-chamber 150 to the supply-side common-liquid-chamber 110 again through an external circulation route.

Note that the driving method of the head 100 is not limited to the above-described example (pull-push discharge). For example, pull discharge or push discharge may be performed in response to the way to apply the drive waveform.

Next, a part related to a liquid circulation system (liquid circulation apparatus 200A) in a first embodiment of the present disclosure is described with reference to FIG. 5.

Figure 5:
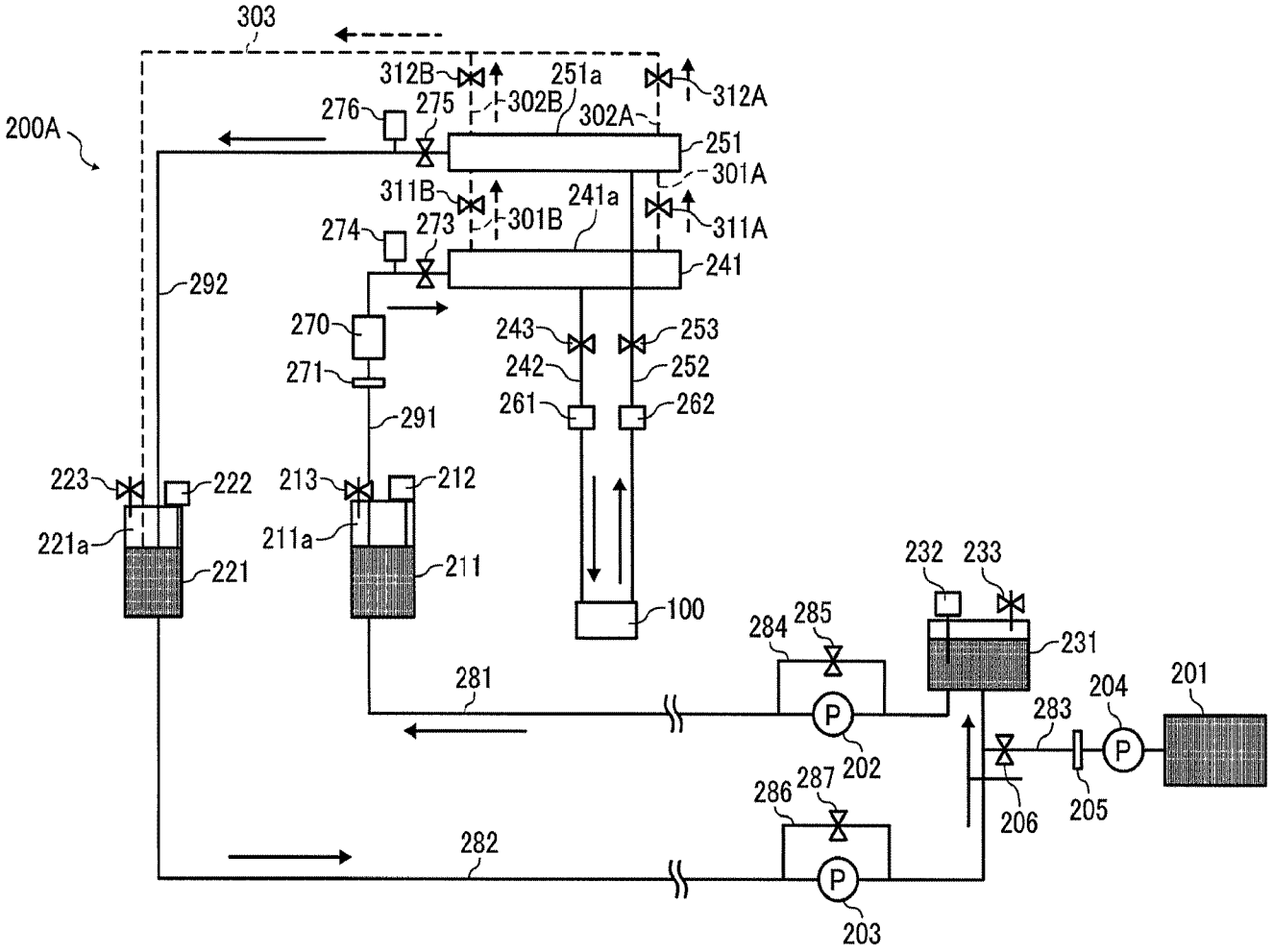
FIG. 5 is a circuit diagram of a liquid circulation system (liquid circulation apparatus) according to a first embodiment of the present disclosure.

FIG. 5 is a circuit diagram of the liquid circulation apparatus 200A according to the first embodiment. The liquid circulation apparatus 200A includes a main tank 201, a first sub tank 211, a second sub tank 221, and a third sub tank 231. The main tank 201 acts as a liquid storing device that stores liquid to be discharged by the heads 100. The first sub tank 211 is an upstream sub tank. The second sub tank 221 is a downstream sub tank. The third sub tank 231 is an intermediate sub tank.

Further, the liquid circulation apparatus 200A includes a first supply pump 202, a second supply pump 203, and a third supply pump 204. The first supply pump 202 feeds the liquid from the third sub tank 231 to the first sub tank 211. The second supply pump 203 feeds the liquid from the second sub tank 221 to the third sub tank 231. The third supply pump 204 feeds the liquid from the main tank 201 to the third sub tank 231.

The liquid circulation apparatus 200A further includes a first manifold 241 as an upstream manifold, a second manifold 251 as a downstream manifold, a pressure head tank 261, a decompression head tank 262, and a degassing device 270. A plurality of heads 100 communicate with the first manifold 241 and the second manifold 251. The pressure head tank 261 and the decompression head tank 262 are provided for each of the heads 100. The degassing device 270 removes dissolved gas in the liquid.

The third sub tank 231 is disposed between the first sub tank 211 and the second sub tank 221. The third supply pump 204 supplies the liquid to the third sub tank 231 from the main tank 201 via a liquid channel 283 that includes a filter 205 and a solenoid valve 206.

The third sub tank 231 includes a liquid detector 232 to detect liquid surface of the liquid in the third sub tank 231 and a solenoid valve 233 that constitutes an air release mechanism to release air inside the third sub tank 231 to the outside air.

The third sub tank 231 and the first sub tank 211 are connected by a liquid channel 281. The first supply pump 202 is provided on the liquid channel 281. Further, the liquid channel 281 is provided with a reverse liquid channel 284 that bypasses the first supply pump 202. A solenoid valve 285 is provided on the reverse liquid channel 284.

The third sub tank 231 and the second sub tank 221 are connected by a liquid channel 282. A second supply pump 203 is provided on the liquid channel 282. Further, the liquid channel 282 is provided with a reverse liquid channel 286 that bypasses the second supply pump 203. A solenoid valve 287 is provided on the reverse liquid channel 286.

The first sub tank 211 includes a gas chamber 211*a*. Thus, liquid and gas coexist in the first sub tank 211. The first sub tank 211 includes a liquid detector 212 to detect liquid surface of the liquid in the first sub tank 211 and a solenoid valve 213 that constitutes an air release mechanism to release inside the first sub tank 211 to the outside air.

The second sub tank 221 includes a gas chamber 221*a*. Thus, liquid and gas coexist in the second sub tank 221. The second sub tank 221 includes a liquid detector 222 to detect liquid surface of the liquid in the second sub tank 221 and a solenoid valve 223 that constitutes an air release mechanism to release inside the second sub tank 221 to the outside air.

The first sub tank 211 is connected to the first manifold 241 via the liquid channel 291 that includes a degassing device 270 and a filter 271. The liquid channel 291 is provided with a solenoid valve 273 for opening and closing the liquid channel 291 and a pressure sensor 274 for detecting a pressure in the liquid channel 291.

The first manifold 241 is connected to a supply port 171 (See FIG. 3) of the head 100 via the supply channel 242. The supply channel 242 is connected to a supply port 171 (See FIG. 3) of the head 100 via the pressure head tank 261. A solenoid valve 243 is provided on an upstream side of the pressure head tank 261 on the supply channel 242 to open and close the supply channel 242.

The second sub tank 221 is connected to the second manifold 251 via the liquid channel 292. The liquid channel 292 is provided with a solenoid valve 275 for opening and closing the liquid channel 292 and a pressure sensor 276 for detecting a pressure in the liquid channel 292.

The second manifold 251 is connected to a discharge port 181 (See FIG. 3) of the head 100 via a discharging channel 252. The discharging channel 252 is connected to a discharge port 181 (See FIG. 3) of the head 100 via the decompression head tank 262. A solenoid valve 253 is provided on a downstream side of the decompression head tank 262 on the discharging channel 252 to open and close the discharging channel 252.

A connection port (liquid supply port) of the first manifold 241 with the liquid channel 291 and a connection port (liquid discharge port) of the second manifold 251 with the liquid channel 292 are provided on the identical end side in a longitudinal direction of each of the first manifold 241 and the second manifold 251.

Here, a circulation channel is configured by a route started from the third sub tank 231 and returned to the third sub tank 231 via the liquid channel 281, the first sub tank 211, the liquid channel 291, the degassing device 270, the first manifold 241, the head 100, the second manifold 251, the second sub tank 221, and the liquid channel 282.

The first manifold 241 includes two first bubble-discharging channels 301 (301A and 301B) at each ends of the first manifold in a longitudinal direction of the first manifold 241.

The first bubble-discharging channels 301 discharges bubbles from the first manifold 241 to the second manifold 251

Two second bubble-discharging channels 302 (302A and 302B) are connected to ends of the second manifold 251 in a longitudinal direction of the second manifold 251. The second bubble-discharging channels 302 discharges bubbles in the second manifold 251 outside the second manifold 251.

The two second bubble-discharging channels 302 are grouped in one common-bubble-discharging channel 303. An outlet of the common-bubble-discharging channel 303 is connected to the gas chamber 221*a* of the second sub tank 221 communicating with the second manifold 251.

In other words, a bubble-discharging channel is constituted by the first bubble-discharging channel 301, the second bubble-discharging channel 302, and the common-bubble-discharging channel 303. The bubble-discharging channel is a channel different from the liquid circulating channel. This "different channel" means a channel (sub channel) different from the circulation channel (main channel) of the liquid. Unlike the circulation channel, a main role of the bubble-discharging channel is not liquid circulation but discharging bubbles. However, the liquid may flow to a different channel at a time of bubble removal during initial filling or at an emergency stop, for example.

The two first bubble-discharging channels 301 (301A and 301B) respectively includes a solenoid valve 311 (311A and 311B). The solenoid valves 311 serve as first on-off valves that open and close the respective first bubble-discharging channels 301A and 301B. Similarly, the two second bubble-discharging channels 302 (302A and 302B) respectively includes a solenoid valve 312 (312A and 312B). The solenoid valves 312 serve as second on-off valves that open and close the respective second bubble-discharging channels 302A and 302B.

Thus, two second bubble-discharging channels 302A and 302B discharge bubbles in the second manifold 251. The two first bubble-discharging channels 301A and 301B are connected to ends of the first manifold 241 in a longitudinal direction of the first manifold 241. The two second bubble-discharging channels 302A and 302B are connected to ends of the second manifold 251 in a longitudinal direction of the second manifold 251.

In addition, the first manifold 241 and the second manifold 251 are disposed such that the second manifold 251 is disposed higher than the first manifold 241. The first bubble-discharging channels 301 are connected to the top surface 241*a* of the first manifold 241, and the second bubble-discharging channels 302 are connected to the top surface 251*a* of the second manifold 251.

Next, a system controller (control circuitry) 500 in the present embodiment is described with reference to FIG. 6.

Figure 6:
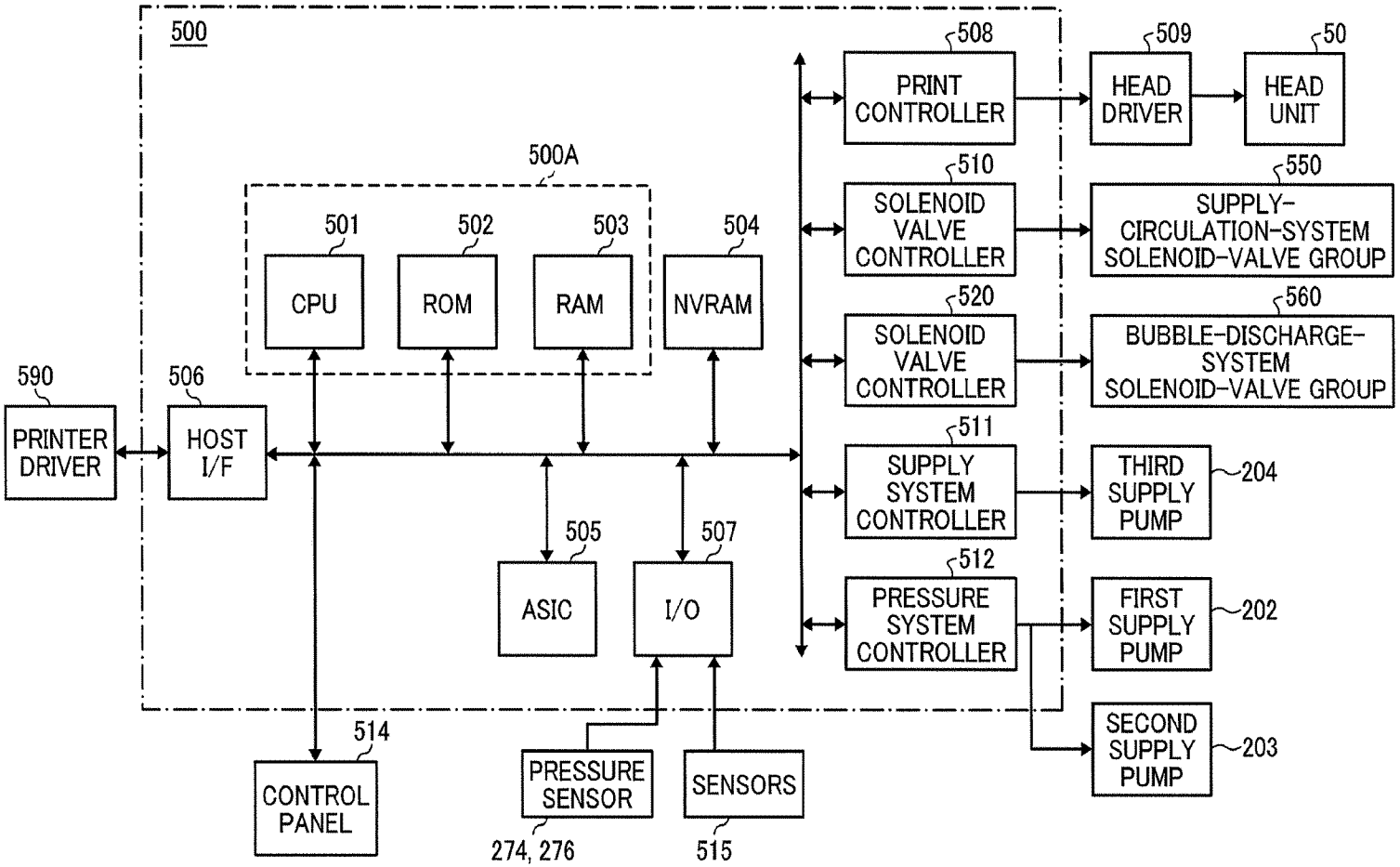
FIG. 6 is a block diagram of a system controller of the liquid circulation system in the first embodiment.

FIG. 6 is a block diagram of the system controller 500. The system controller 500 includes a main system controller 500A including a central processing unit (CPU) 501, a read only memory (ROM) 502, and a random access memory (RAM) 503. The CPU 501 controls the overall apparatus. The ROM 502 stores fixed data including various programs to be executed by the CPU 501. The RAM 503 temporarily store data such as image data.

The system controller 500 includes a rewritable nonvolatile random access memory (NVRAM) 504 to retain data during the apparatus is powered off. The system controller 500 includes an application specific integrated circuit (ASIC) 505 to perform image processing, such as various signal processing and sorting, on image data and to process input/output signals to control the apparatus entirely.

The system controller 500 also includes a print controller 508 and a driver integrated circuit (hereinafter, head driver) 509. The print controller 508 includes a data transmitter, a drive signal generator, and a bias voltage output unit to drive and control each of the heads 100 of a head unit 50. The head driver 509 drives each of the heads 100.

The system controller 500 includes a solenoid valve controller 510 to control driving of a supply-circulation-system solenoid-valve group 550. The supply-circulation-system solenoid-valve group 550 includes solenoid valves 206, 273, 243, 253, and 275 in a supply circulation channel, solenoid valves 213, 223, and 233 for opening the liquid circulation apparatus 200A to atmosphere, solenoid valves 285 and 287 in the reverse liquid channels 284 and 286, for example.

The system controller 500 includes a solenoid valve controller 520 that drives and controls a bubble-discharge-system solenoid-valve group 560. The bubble-discharge-system solenoid-valve group 560 includes solenoid valves 311A, 311B, 312A, and 312B.

The system controller 500 includes a supply system controller 511 to control driving of a third supply pump 204.

The system controller 500 includes a pressure system controller 512 to control driving of a first supply pump 202 and a second supply pump 203.

The system controller 500 further includes an input/output (I/O) unit 507. The I/O unit 507 performs various sensor data and acquires detection results from pressure sensors 274 and 276 and information from various types of sensors 515 mounted in the liquid discharge apparatus 1000.

The I/O unit 507 also extracts data for controlling the liquid discharge apparatus 1000, and uses extracted data to control the print controller 508, the solenoid valve controller 510 and 520, the supply system controller 511, and the pressure system controller 512.

A control panel 514 used to input and display information necessary to the liquid discharge apparatus 1000 is connected to the system controller 500.

Next, a liquid circulation method in the liquid circulation apparatus 200A (liquid circulation system) in the present disclosure is described.

(1) Liquid flow from the main tank 201 to the third sub tank 231. When the liquid detector 232 detects liquid shortage in the third sub tank 231, the system controller 500 drives the third supply pump 204 to supply the liquid to the third sub tank 231 from the main tank 201 via the liquid channel 283 until the liquid detector 232 detects that the liquid level in the third sub tank 231 is full.

(2) Liquid flow from the third sub tank 231 to the first sub tank 211. The system controller 500 supplies the liquid from the third sub tank 231 to the first sub tank 211 via the liquid channel 281 by driving the first supply pump 202.

(3) Liquid flow from the second sub tank 221 to the third sub tank 231. The system controller 500 supplies the liquid from the second sub tank 221 to the third sub tank 231 via the liquid channel 282 by driving the second supply pump 203.

(4) Liquid flow from the first sub tank 211 to the second sub tank 221 through the heads 100 that are liquid-circulable.

The system controller 500 supplies the liquid to the first sub tank 211 by driving the first supply pump 202 until the pressure sensor 274 detects a target pressure (positive pressure, for example). Further, the system controller 500 supplies the liquid to the third sub tank 231 by driving the second supply pump 203 until the pressure sensor 276 detects a target pressure (negative pressure, for example).

Thus, a differential pressure is generated between the first sub tank 211 and the second sub tank 221. According to this differential pressure, the liquid is calculable from the first sub tank 211 to the second sub tank 221 via the liquid channel 291, the filter 271, the degassing device 270, the first manifold 241, a plurality of the supply channels 242, a plurality of pressure head tanks 261, a plurality of heads 100, a plurality of discharging channels 252, a plurality of the decompression head tanks 262, the second manifold 251, and the liquid channel 292.

Next, a formation of a negative pressure in a nozzle meniscus in the nozzles 104 is described below.

Generally, the pressure applied on the nozzle meniscus is controlled to be negative when the head 100 discharges liquid. The negative pressure inside the nozzles 104 prevents a leak or an overflow of liquid from the nozzles 104. Further, pulsation of the pressure may be generated in the nozzle meniscus at a start and an end of the discharge process when the high-speed discharge is performed. At this time, the negative pressure in the nozzles 104 prevents a leak or an overflow of liquid from the nozzles 104 even when the positive pressure is temporary generated in the nozzles 104 by the pulsation.

When a circulation type liquid discharge head is used, generally, a pressure in the first sub tank 211 is set to positive and a pressure in the second sub tank 221 is set to negative.

More specifically, a fluid resistance R1 and a fluid resistance R2 are previously calculated or measured. The fluid resistance R1 is a fluid resistance from the first sub tank 211 to the nozzle meniscus in the head 100. The fluid resistance R2 is a fluid resistance from the nozzle meniscus in the head 100 to the second sub tank 221.

Then, a pressure V1 of the first sub tank 211 and a pressure V2 of the second sub tank 221 are set according to the fluid resistance R1 and R2. Thus, a target negative pressure V can be generated in the nozzle meniscus according to a fluid resistance ratio of R1 and R2 and values of the pressures V1 and V, as similar to a voltage division of series resistance.

If a flow rate of circulated liquid is referred to as "I", $$V-V1=I\times R1\ V2-V=I\times R2.$$

Here, the following equation is obtained by deleting "I" from both sides of the above-described equations and transforming the above-described equations.

$$V=(V2+R2/R2\times V1)/(1+R2/R1).$$

Thus, it is understood that the pressure in the nozzle meniscus is determined according to the set pressure and the fluid resistance ratio.

In the above-described explanation, the system controller 500 applies a positive pressure on the first sub tank 211. However, the system controller 500 may apply a negative pressure on the first sub tank 211 and control the negative pressure in the second sub tank 221 to be greater than the negative pressure in the first sub tank 211 to generate differential pressure for liquid circulation.

The advantage of the present configuration is that the liquid can be circulated while reducing the liquid leakage from the nozzles 104 compared to the above-described embodiments because the negative pressure is also applied on the first sub tank 211.

Next, a bubble discharging operation is described.

In the present embodiment, bubbles move from the first manifold 241 to the second manifold 251 by opening the solenoid valve 311 of the first bubble-discharging channel 301.

At this time, by disposing the second manifold 251 at a position higher than the first manifold 241, bubbles can be efficiently discharged from the first manifold 241 to the second manifold 251. Further, since the first bubble-discharging channel 301 is communicated with the bottom surface of the second manifold 251, the bubbles can move without staying in the first bubble-discharging channel 301.

In addition, by opening the solenoid valve 312 of the second bubble-discharging channel 302, bubbles move from the second manifold 251 to the common-bubble-discharging channel 303 and are discharged to the gas chamber 221*a* of the second sub tank 221.

In this manner, bubbles are discharged by the bubble-discharging channel configured by the first bubble-discharging channel 301, the second bubble-discharging channel 302, and the common-bubble-discharging channel 303 that are channels different from the liquid channels 281, 282, 283, 291, and 292.

Thus, the flow of the liquid is not obstructed by the bubbles. Further, even if the inner diameter of the bubble-discharging channel is reduced, the inner diameter of the liquid channel does not change, so that the liquid flow rate can be secured.

Further, by arranging an outlet of the bubble-discharging channel in the gas chamber 221*a* of the second sub tank 221, the discharged bubbles can be sent to the gas chamber 221*a* as it is.

In addition, by connecting the first bubble-discharging channels 301A and 301B to longitudinal ends of the first manifold 241 and connecting the second bubble-discharging channels 302A and 302B to longitudinal ends of the second manifold 251, respectively, bubbles can be further efficiently discharged.

As to the order of opening the solenoid valves 311A, 311B, 312A, 312B, the solenoid valve 311A on one end of the first manifold 241 and the solenoid valve 312B on another end of the second manifold 251 are opened first.

Thus, one of the two first solenoid valves 311A and 311B communicating with one end of the first manifold 241 in the longitudinal direction of the first manifold 241 and one of the two second solenoid valves 312A and 312B communicating with another end of the second manifold 251 in the longitudinal direction of the second manifold 251 are opened to discharge bubbles in the first manifold 241 and the second manifold 251.

That is, the first manifold 241 communicates with the second manifold 251 via the first bubble-discharging channel 301A at one end of the first manifold that is far from another end of the liquid inflow side of the first manifold 241. Another end of the second manifold 251 close to the liquid discharge side of the second manifold 251 communicates with the common-bubble-discharging channel 303 via the second bubble-discharging channel 302B. Note that the "end" here means the region between the center and the end, and is not limited to the end.

As a result, a liquid flow can be generated over the entire area of the first manifold 241 and the second manifold 251.

After the solenoid valves 311A and 312B are opened, the solenoid valves 311B and 312B may also be opened to continue the bubble-discharging operation. Alternatively, only the solenoid valves 311A and 312B may be continuously opened to continue the bubble-discharging operation after the solenoid valves 311A and 312B are opened.

In this case, the liquid flow over the entire area can be generated by arranging one end of the first manifold 241 at a liquid inflow side and one end of the second manifold 251 at a liquid discharge side on a same side in the longitudinal direction of the first manifold 241 and the second manifold 251.

Next, a liquid circulation system (liquid circulation apparatus 200B) in a second embodiment of the present disclosure is described below with reference to FIG. 7.

Figure 7:
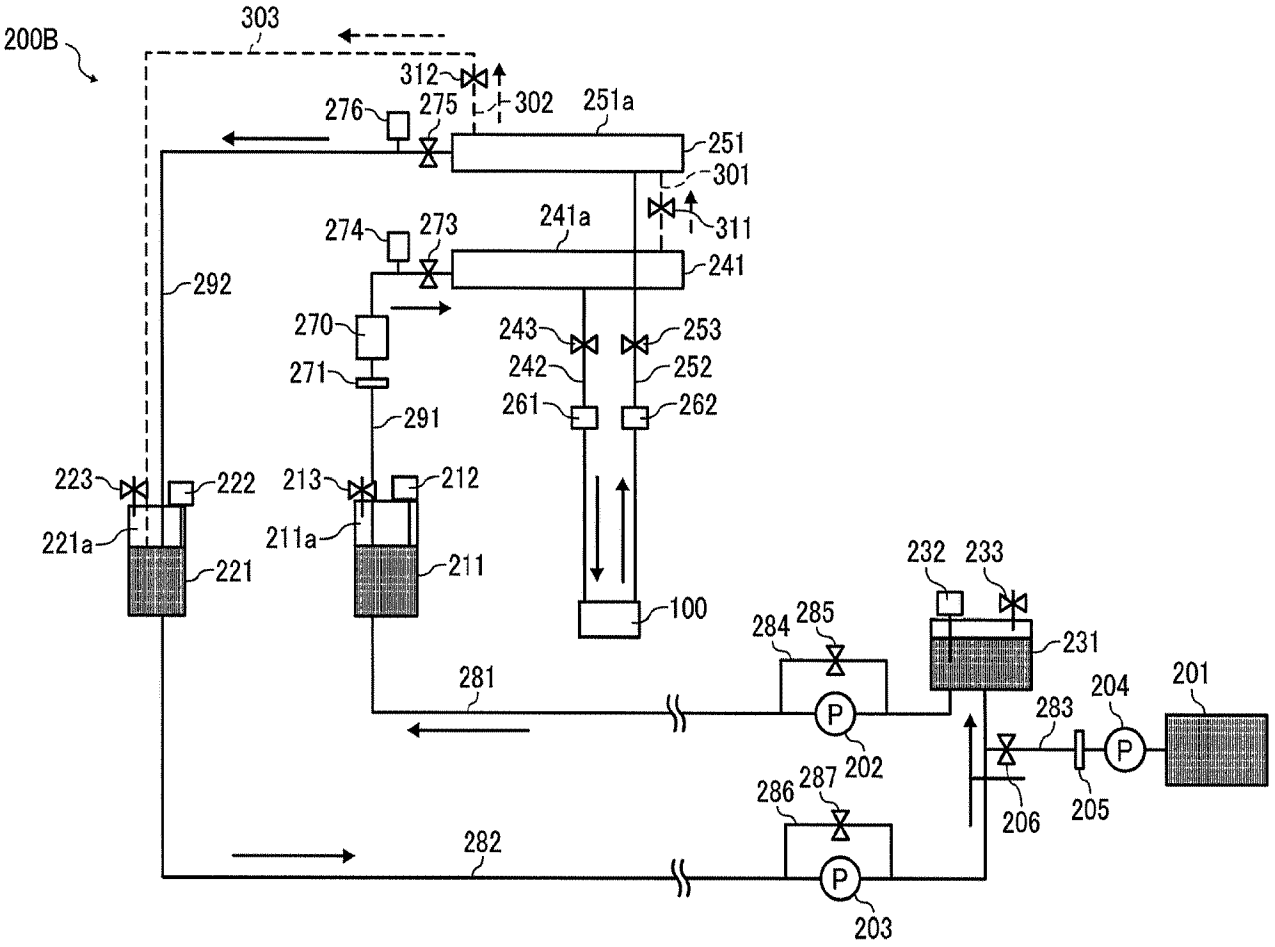
FIG. 7 is a schematic view of a liquid circulation system (liquid circulation apparatus) according to a second embodiment of the present disclosure.

FIG. 7 is a schematic view of a liquid circulation apparatus 200B according to the second embodiment. In the present embodiment, one end of the first bubble-discharging channel 301 communicates with an end opposite to the liquid inflow side of the first manifold 241 and another end of the first bubble-discharging channel 301 communicates with an end opposite to the liquid discharge side of the second manifold 251. The second bubble-discharging channel 302 communicates with an end of the second manifold 251 on the liquid discharge side.

Thus, one end of the first bubble-discharging channel 301 communicates with one end of the first manifold 241 opposite to a liquid inflow side of the first manifold 241. Another end of the first bubble-discharging channel 301 communicates with one end of the second manifold 251 opposite to another end of the second manifold 251 at a liquid discharge side. The second bubble-discharging channel 302 communicates with the another end of the second manifold 251 at the liquid discharge side.

The solenoid valve 311 is provided on the first bubble-discharging channel 301, and the solenoid valve 312 is provided on the second bubble-discharging channel 302.

With this configuration as well, it is possible to generate a liquid flow in the entire area of the first manifold 241 and the second manifold 251, and finally discharge bubbles from the second bubble-discharging channel 302 communicating with the second manifold 251 it can.

In the present embodiment, one end of the first bubble-discharging channel 301 communicates with the end opposite to the liquid inflow side in the first manifold 241, and the other end of the first bubble-discharging channel 301 communicates with the liquid of the second manifold 251 And the second bubble-discharging channel 302 communicates with the end on the liquid discharge side of the second manifold 251.

Thus, the second embodiment can reduce the number of bubble-discharging channels as compared with the first embodiment. Further, the bubbles can be discharged by a bubble-discharging channel disposed further downstream than a bubble generation source even when the bubble generation source is on the downstream side of the first manifold 241 such as the head 100 connected to the extreme downstream end of the first manifold 241.

Next, a liquid circulation system (liquid circulation apparatus 200C) in a third embodiment of the present disclosure is described below with reference to FIG. 8.

Figure 8:
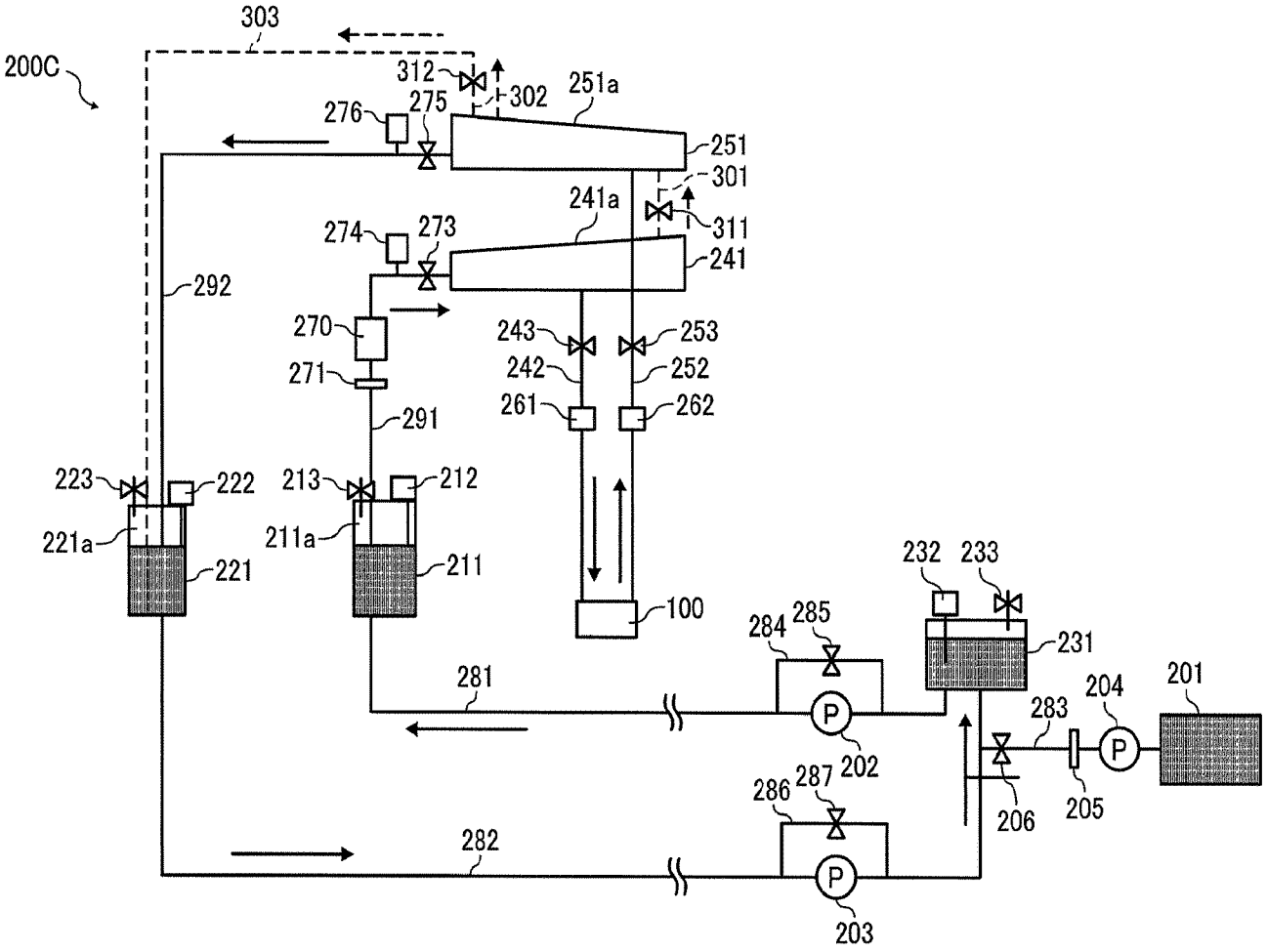
FIG. 8 is a schematic view of a liquid circulation system (liquid circulation apparatus) according to a third embodiment of the present disclosure.

FIG. 8 is a schematic view of a liquid circulation apparatus 200C according to the third embodiment. In the present embodiment, a top surface 241*a* of the first manifold 241 is inclined to be higher from one end at the liquid inflow side (left side in FIG. 8) of the first manifold 241 toward another end (right side in FIG. 8) opposite to the one end of the first manifold 241. The first bubble-discharging channel 301 is connected to the another end (higher end) of the first manifold 241 opposite to the one end (lower end) at the liquid inflow side (left side in FIG. 8) of the first manifold 241.

Another end of the first bubble-discharging channel 301 communicates with one end of the second manifold 251 opposite to another end at liquid discharge side of the second manifold 251.

A top surface 251*a* of the second manifold 251 is inclined to be higher from the one end toward the another end at the liquid discharge side (left side in FIG. 8) of the second manifold 251 opposite to the one end. The second bubble-discharging channel 302 is connected to the one end (higher end) at the liquid discharge side (left side in FIG. 8) of the second manifold 251.

Each of the top surfaces 241*a* and 251*a* of the first manifold 241 and the second manifold 251 is inclined in the longitudinal direction of the first manifold 241 and the second manifold 251. Thus, bubbles can be collected at each higher end of the first manifold 241 and the second manifold 251 by buoyant force. It is to be noted that "one end" means an end on the lower side in inclination and "another end" means the end on the higher side in inclination.

Accordingly, even if the first bubble-discharging channel 301 and the second bubble-discharging channel 302 are formed as one channel, bubbles can be reliably discharged. Further, the configuration of the liquid discharge apparatus 200C is simplified compared to the first and second embodiments.

Note that the configuration for inclining the top surfaces 241*a* and 251*a* may be either a configuration in which the top surfaces 241*a* and 251*a* itself are inclined or a configuration in which the entire of first manifold 241 and second manifold 251 are tilted.

Next, a liquid circulation system (liquid supply apparatus 200D) in a fourth embodiment of the present disclosure is described below with reference to FIG. 9.

Figure 9:
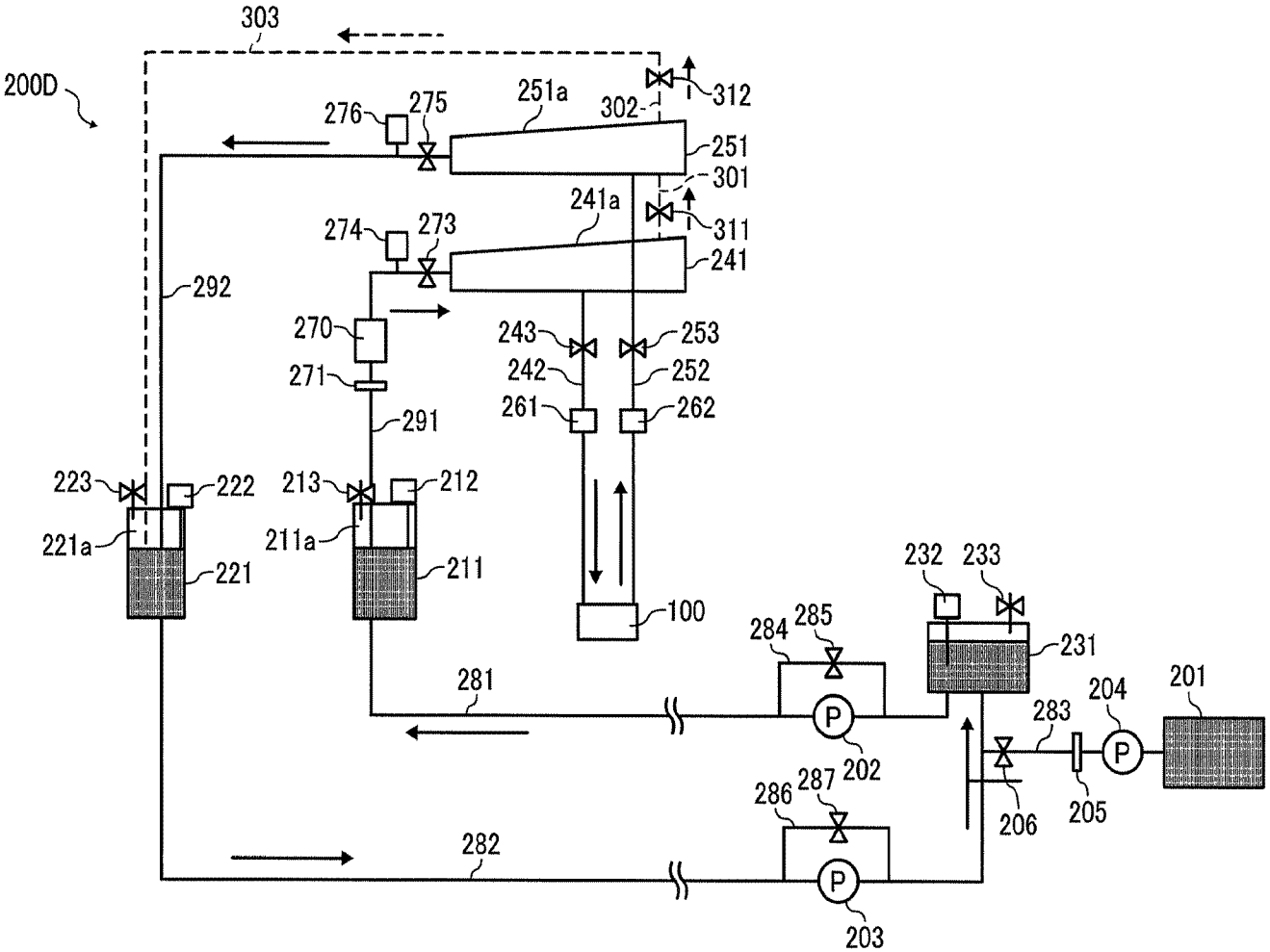
FIG. 9 is a schematic view of a liquid circulation system (liquid circulation apparatus) according to a fourth embodiment of the present disclosure.

FIG. 9 is a schematic view of a liquid circulation apparatus 200D according to the fourth embodiment. In the fourth embodiment, a top surface 251*a* of the second manifold 251 is inclined to be higher from the one end at the liquid discharge side (left side in FIG. 9) toward the another end (right side in FIG. 9) opposite to the one end of the second manifold 251. The second bubble-discharging channel 302 is connected to the another end (higher end) opposite to the one end (lower end) at liquid discharge side (left side in FIG. 9) of the second manifold 251.

With this configuration as well, bubbles can be collected at one of longitudinal end of the first manifold 241 and the second manifold 251 by buoyant force by inclining the top surfaces 241*a* and 251*a* of the first manifold 241 and the second manifold 251 in the longitudinal direction of the first manifold 241 and the second manifold 251.

Therefore, as in the third embodiment, bubbles can be reliably discharged even if the first bubble-discharging channel 301 and the second bubble-discharging channel 302 are formed as one channel. Further, the configuration of the liquid circulation apparatus 200D is simplified.

In addition, the bubbles that have moved from the first manifold 241 to the second manifold 251 through the first bubble-discharging channel 301 are smoothly ascent to the portion where the second bubble-discharging channel 302 is connected to the second manifold 251 by the buoyant force. As a result, since the bubbles do not move inside the second manifold 251 along the longitudinal direction of the second manifold 251, the fourth embodiment can prevent the bubbles to be dissolved into the liquid in the second manifold 251 while preventing the bubbles to be supplied to the heads 100.

Next, a liquid circulation system (liquid circulation apparatus 200E) in a fifth embodiment of the present disclosure is described below with reference to FIG. 10.

Figure 10:
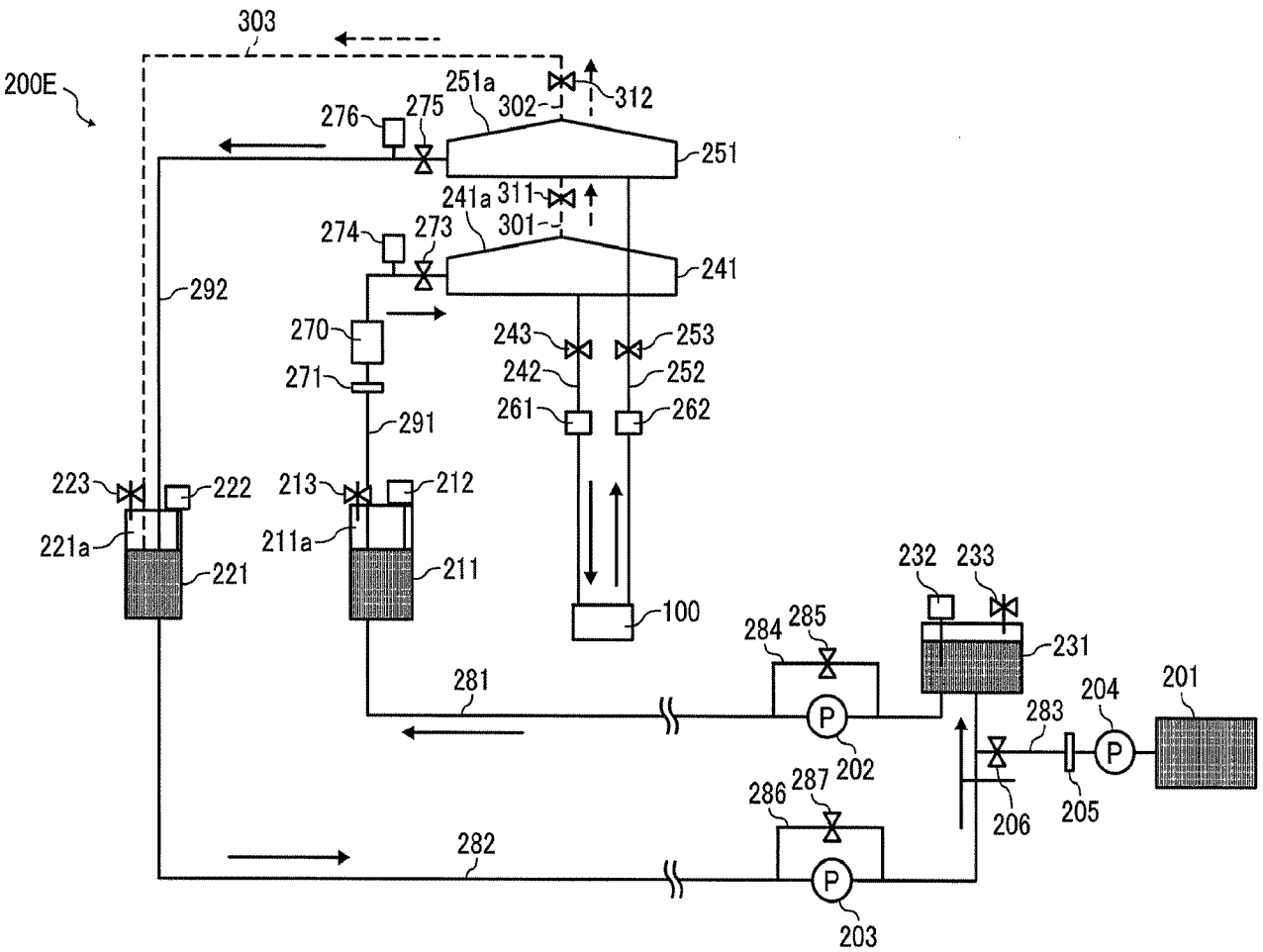
FIG. 10 is a schematic view of a liquid circulation system (liquid circulation apparatus) according to a fifth embodiment of the present disclosure.

FIG. 10 is a schematic view of a liquid circulation apparatus 200E according to the fifth embodiment. In the present embodiment, the top surface 241*a* of the first manifold 241 is inclined to be higher from both ends toward a center in the longitudinal direction of the first manifold 241. The first bubble-discharging channel 301 is connected to the higher portion of the top surface 241*a* of the first manifold 241.

Similarly, the top surface 251*a* of the second manifold 251 is inclined to be higher from both ends toward the center in the longitudinal direction of the second manifold 251. The second bubble-discharging channel 302 is connected to the highest portion of the top surface 251*a* of the second manifold 251.

With this configuration as well, bubbles can be collected by a buoyant force at the central portions of the top surfaces 241*a* and 251*a* of the first manifold 241 and the second manifold 251.

Therefore, as in the third embodiment, bubbles can be reliably discharged even if the first bubble-discharging channel 301 and the second bubble-discharging channel 302 are formed as one channel. Further, the configuration of the liquid circulation apparatus 200E is simplified.

In addition, the bubbles that have moved from the first manifold 241 to the second manifold 251 through the first bubble-discharging channel 301 ascend to the portion where the second bubble-discharging channel 302 is connected to the second manifold 251 by the buoyant force. The bubbles do not move inside the second manifold 251 in the longitudinal direction of the second manifold 251. Thus, the fifth embodiment can prevent the bubbles to be supplied to the heads 100.

Further, the first bubble-discharging channel 301 and the second bubble-discharging channel 302 are provided in vicinities of the center of first manifold 241 and the second manifold 251, respectively. Thus, minute change in pressure occurred by opening and closing the solenoid valves provided in the first bubble-discharging channel 301 and the second bubble-discharging channel 302 is symmetrically transmitted from the vicinity of the center toward the upstream side and the downstream side of the first manifold 241 and the second manifold 251.

Thus, the fifth embodiment can reduce printing unevenness caused by a pressure change, for example, as compared with an embodiment in which the first bubble-discharging channel 301 and the second bubble-discharging channel 302 are connected to an vicinity of one of the ends of the first manifold 241 and the second manifold 251, respectively.

In the present disclosure, discharged "liquid" is not limited to a particular liquid as long as the liquid has a viscosity or surface tension to be discharged from a head. However, preferably, the viscosity of the liquid is not greater than 30 mPa·s under ordinary temperature and ordinary pressure or by heating or cooling.

Examples of the liquid include a solution, a suspension, or an emulsion including, for example, a solvent, such as water or an organic solvent, a colorant, such as dye or pigment, a functional material, such as a polymerizable compound, a resin, or a surfactant, a biocompatible material, such as DNA, amino acid, protein, or calcium, and an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

"The liquid discharge head" includes an energy source for generating energy to discharge liquid. Examples of the energy source include a piezoelectric actuator (a laminated piezoelectric element or a thin-film piezoelectric element), a thermal actuator that employs a thermoelectric conversion element, such as a heating resistor (element), and an electrostatic actuator including a diaphragm and opposed electrodes.

In the present disclosure, "liquid discharge apparatus" refers to an apparatus including a liquid discharge head or a liquid discharge unit, configured to discharge a liquid by driving the liquid discharge head. The liquid discharge apparatus may be, for example, an apparatus capable of discharging liquid to a material to which liquid can adhere or an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, on which the liquid has been discharged.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers, so as to form a three-dimensional fabrication object.

In addition, "the liquid discharge apparatus" is not limited to such an apparatus to form and visualize meaningful images, such as letters or figures, with discharged liquid. For example, the liquid discharge apparatus may be an apparatus to form meaningless images, such as meaningless patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "medium on which liquid can be adhered" include recording media, such as paper sheet, recording paper, recording sheet of paper, film, and cloth, electronic component, such as electronic substrate and piezoelectric element, and media, such as powder layer, organ model, and testing cell.

The "medium on which liquid can be adhered" includes any medium on which liquid is adhered, unless particularly limited.

Examples of "the material on which liquid can be adhered" include any materials on which liquid can be adhered even temporarily, such as paper, thread, fiber, fabric, leather, metal, plastic, glass, wood, and ceramic.

"The liquid discharge apparatus" may be an apparatus to relatively move a head and a medium on which liquid can be adhered. However, the liquid discharge apparatus is not limited to such an apparatus. For example, the liquid discharge apparatus may be a serial head apparatus that moves the head or a line head apparatus that does not move the head.

Examples of "the liquid discharge apparatus" further include a treatment liquid coating apparatus to discharge a treatment liquid to a sheet surface to coat the sheet surface with the treatment liquid to reform the sheet surface and an injection granulation apparatus to eject a composition liquid including a raw material dispersed in a solution from a nozzle to mold particles of the raw material.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid circulation apparatus for circulating liquid through a plurality of discharge heads, each of the plurality of discharge heads including a supply port, a discharge port, and discharge nozzles, the liquid circulation apparatus comprising:

a liquid circulating channel to circulate the liquid via the plurality of discharge heads;

a first manifold connected to the supply port of each of the plurality of discharge heads;

a second manifold connected to the discharge port of each of the plurality of discharge heads;

a discharging channel to discharge the liquid in the second manifold;

a bubble-discharging channel separate from the discharging channel, to discharge bubbles in the second manifold.

2. The liquid circulation apparatus according to claim 1, wherein an outlet of the bubble-discharging channel is disposed inside a sub tank communicating with the second manifold.

3. The liquid circulation apparatus according to claim 1, further comprising two bubble-discharging channels to discharge bubbles in the second manifold, wherein the two bubble-discharging channels are connected to ends of the second manifold in a longitudinal direction of the second manifold.

4. The liquid circulation apparatus according to claim 1, wherein a top surface of the second manifold is either inclined to be higher from one end toward another end of the second manifold or inclined to be higher from both ends toward a center in a longitudinal direction of the second manifold, wherein the bubble-discharging channel is connected to a higher portion of the top surface of the second manifold.

5. A liquid circulation apparatus for circulating liquid through a plurality of discharge heads, each of the plurality of discharge heads including a supply port, a discharge port, and discharge nozzles, the liquid circulation apparatus comprising:

a liquid circulating channel to circulate the liquid via the plurality of discharge heads;

a first manifold connected to the supply port of each of the plurality of discharge heads;

a second manifold connected to the discharge port of each of the plurality of discharge heads;

a first bubble-discharging channel to discharge bubbles from the first manifold to the second manifold;

a second bubble-discharging channel to discharge bubbles in the second manifold outside the second manifold, wherein the first bubble-discharging channel and the second bubble-discharging channel are different from the liquid circulating channel.

6. The liquid circulation apparatus according to claim 5, wherein the second manifold is disposed higher than the first manifold.

7. The liquid circulation apparatus according to claim 5, wherein an outlet of the second bubble-discharging channel is disposed inside a sub tank communicating with the second manifold.

8. The liquid circulation apparatus according to claim 5, further comprising:

two first bubble-discharging channels to discharge bubbles in the first manifold; and two second bubble-discharging channels to discharge bubbles in the second manifold, wherein the two first bubble-discharging channels are connected to ends of the first manifold in a longitudinal direction of the first manifold, and the two second bubble-discharging channels are connected to ends of the second manifold in a longitudinal direction of the second manifold.

9. The liquid circulation apparatus according to claim 8, further comprising:

two first solenoid valves to open and close the two first bubble-discharging channels; and two second solenoid valves to open and close the two second bubble-discharging channels, wherein one of the two first solenoid valves communicating with one end of the first manifold in the longitudinal direction of the first manifold and one of the two second solenoid valves communicating with another end of the second manifold in the longitudinal direction of the second manifold are opened to discharge bubbles in the first manifold and the second manifold.

10. The liquid circulation apparatus according to claim 8, wherein one end of the first manifold at a liquid inflow side and one end of the second manifold at a liquid discharge side are disposed on a same side in the longitudinal direction of each of the first manifold and the second manifold.

11. The liquid circulation apparatus according to claim 5, wherein one end of the first bubble-discharging channel communicates with one end of the first manifold opposite to a liquid inflow side of the first manifold, and another end of the first bubble-discharging channel communicates with one end of the second manifold opposite to another end of the second manifold at a liquid discharge side, and the second bubble-discharging channel communicates with the another end of the second manifold at the liquid discharge side.

12. The liquid circulation apparatus according to claim 5, wherein a top surface of the first manifold is either inclined to be higher from one end toward another end of the first manifold or inclined to be higher from both ends toward a center in a longitudinal direction of the first manifold, wherein the first bubble-discharging channel is connected to a higher portion of the top surface of the first manifold.

13. The liquid circulation apparatus according to claim 5, wherein a top surface of the second manifold is either inclined to be higher from one end toward another end of the second manifold or inclined to be higher from both ends toward a center in a longitudinal direction of the second manifold, wherein the second bubble-discharging channel is connected to a higher portion of the top surface of the second manifold.

14. A liquid discharge apparatus comprising:

the plurality of discharge heads; and the liquid circulation apparatus according to claim 1, to circulate liquid in the plurality of discharge heads.

* * * * *